US008224195B2

(12) United States Patent
Zollner et al.

(10) Patent No.: US 8,224,195 B2
(45) Date of Patent: Jul. 17, 2012

(54) METHOD FOR CONTROLLING A DEVELOPMENT PROCESS IN DIFFERENT OPERATING PHASES

(75) Inventors: Alfred Zollner, Eitting (DE); Markus Jeschonek, Oberding (DE)

(73) Assignee: Oce Printing Systems GmbH, Poing (DE)

( * ) Notice: Subject to any disclaimer, the term of this patent is extended or adjusted under 35 U.S.C. 154(b) by 448 days.

(21) Appl. No.: 12/515,987

(22) PCT Filed: Dec. 10, 2007

(86) PCT No.: PCT/EP2007/063576

§ 371 (c)(1),
(2), (4) Date: May 22, 2009

(87) PCT Pub. No.: WO2008/071647

PCT Pub. Date: Jun. 19, 2008

(65) Prior Publication Data

US 2010/0046971 A1 Feb. 25, 2010

(30) Foreign Application Priority Data

Dec. 12, 2006 (DE) ..... 10 2006 058 582

(51) Int. Cl.
*G03G 15/08* (2006.01)

(52) U.S. Cl. ..... 399/29; 399/53

(58) Field of Classification Search ..... 399/27, 399/29, 30, 53

See application file for complete search history.

(56) References Cited

U.S. PATENT DOCUMENTS 4,614,165 A 9/1986 Folkins et al.
5,678,131 A 10/1997 Alexandrovich et al.
5,887,221 A * 3/1999 Grace ..... 399/49
6,085,050 A * 7/2000 Rowe et al. ..... 399/75

(Continued)

FOREIGN PATENT DOCUMENTS

DE 196 31 261 A1 2/1997

(Continued)

OTHER PUBLICATIONS

Trickle—Continuous Developer Material Replenishment for Two Component Development Systems—Steven C. Hart et al—Oct. 21, 1990—pp. 44-54.

*Primary Examiner* — David Gray
*Assistant Examiner* — G. M. Hyder
(74) *Attorney, Agent, or Firm* — Schiff Hardin LLP

(57) ABSTRACT

In a method to control a development process and an electrographic process, at least one developer station inks a latent image on a carrier with a toner. The toner is extracted from a mixture of toner and toner particles and wherein first toner is supplied to the mixture. A characteristic value is determined for a status of the mixture from a model calculation in which a toner exchange rate and an operating aging rate are linked. The development process is at least one of monitored, controlled, or regulated depending on the characteristic value. Also in a related method for controlling a development process, a characteristic value is determined for a status of the mixture from a model calculation in which a change of a toner consumption rate for the toner within a time interval during operation of the developer station and a time constant are taken into account. At least one of monitoring, controlling, or regulating the development process depends on the characteristic value.

19 Claims, 8 Drawing Sheets

U.S. PATENT DOCUMENTS

| | | | | |
|---|---|---|---|---|
| 6,173,133 | B1 | 1/2001 | Donaldson et al. | |
| 6,248,496 | B1 | 6/2001 | Galloway et al. | |
| 6,792,218 | B2 | 9/2004 | Tungate, Jr. et al. | |
| 7,079,794 | B2 * | 7/2006 | Forbes et al. | 399/257 |
| 7,433,613 | B2 | 10/2008 | Zollner et al. | |
| 2006/0008281 | A1 * | 1/2006 | Matsumoto et al. | 399/27 |

FOREIGN PATENT DOCUMENTS

| | | | |
|---|---|---|---|
| DE | 102 33 671 | A1 | 2/2004 |
| EP | 1 591 841 | A2 | 11/2005 |

* cited by examiner

METHOD FOR CONTROLLING A DEVELOPMENT PROCESS IN DIFFERENT OPERATING PHASES

BACKGROUND

The preferred embodiment concerns methods to control a development process in an electrographic printer or copier in which at least one developer station inks a latent image on an intermediate carrier with toner of a predetermined color, wherein the toner draws a mixture of toner and carrier particles and fresh toner from a reservoir supplied to the mixture.

In printing of recording media with single color or multicolor toner images, latent images on an intermediate carrier are inked by a respective developer station per toner color used. In operation, the size of the inked area on the recording media can fluctuate significantly, which is expressed by the degree of areal coverage. Given operation with low areal coverage, the toner consumption is also correspondingly low, which can affect the print quality. Operating phases with low or extremely low areal coverage are typically designated as low take-out operation (LTO operation) or no take-out operation (NTO operation). Given a multicolor printing, the areal coverage per color component is to be taken into account. It can hereby occur that an LTO operation exists for one specific toner color while the areal coverage as a whole is high. For example, given what is known as highlight color operation in which only single image elements are highlighted in color on a black-and-white image, the toner consumption for this color can be very low in relation to black toner. Given full color applications, the toner consumption per color is generally greater. Fluctuations in the inking of individual colors due to different toner consumption here are distinctly perceived as color shift, however. The degraded print quality in LTO or NTO operation has multiple causes, wherein a certain toner waste is hereby significant. On the one hand, the triboelectric properties, and therefore the adhesion properties of the toner particles to the intermediate carrier, change as a consequence of the agitation of the mixture of toner particles and carrier particles (in general ferromagnetic carrier particles). On the other hand, the mixture can change in terms of its mechanical properties due to the interaction between carrier particles and toner particles, in particular in the agitation of the mixture. Both effects can lead to a measurement error in the registration of the toner concentration with the aid of a sensor, with the consequence that overall the toner concentration in the mixture drops in a toner concentration regulation system. The connection between low triboelectric adhesion and low toner concentration leads to a reduced inking on the intermediate carrier and/or to degraded conditions for the transfer of the toner particles from intermediate carrier to the recording media (paper, for example). The print quality can suffer as a whole under this. A precise measurement of the properties of the mixture made up of toner and carrier particles is technically impossible due to the complex mechanical and electrical behavior of the mixture; sensors for this are also not present. It therefore appears reasonable to develop characteristic values using which the status and the behavior of the mixture can be estimated.

Document U.S. Pat. No. 6,173,133 describes a toner concentration regulation in which compensation algorithms are used. In addition to the temperature compensation of a sensor measuring the toner concentration, parameters for compensation of the break-in (break-in compensation) of the developer mixture and a toner aging compensation (toner age compensation) are also implemented.

Additional documents of the prior art are U.S. Pat. Nos. 6,047,142, 6,871,029, 7,079,794 and 7,085,506.

A method and a device to adjust the toner concentration in the developer station of an electrophotographic printer or copier is also known from WO 2004/012015 A1.

Document U.S. Pat. No. 4,614,165 describes a method and a developer device, in which method or in which developer device the entire mixture comprising toner and carrier particles is exchanged when toner and carrier have reached a predetermined age. An aging rate is determined that depends on the number of generated copies. Toner and carrier are then exchanged depending on this aging rate.

A method to calculate the toner age and the carrier age for printer diagnosis is known from document EP 1 951 841 A. A maximum toner age is stored in a memory. The current toner concentration in the developer mixture is measured, and the consumption rate for the developer and the toner is calculated from this. The toner age is determined on the basis of the toner concentration and the consumption of developer. A print job is interrupted if the maximum toner age is reached.

SUMMARY

It is an object of the invention to specify methods to control a developer process which ensure a high print quality given changing operating states, in particular in LTO operation.

In a method to control a development process and an electrographic process, at least one developer station inks a latent image on a carrier with a toner. The toner is extracted from a mixture of toner and toner particles and wherein first toner is supplied to the mixture. A characteristic value is determined for a status of the mixture from a model calculation in which a toner exchange rate and an operating aging rate are linked. The development process is at least one of monitored, controlled, or regulated depending on the characteristic value. Also in a related method for controlling a development process, a characteristic value is determined for a status of the mixture from a model calculation in which a change of a toner consumption rate for the toner within a time interval during operation of the developer station and a time constant are taken into account. At least one of monitoring, controlling, or regulating the development process depends on the characteristic value.

DESCRIPTION OF THE PREFERRED EMBODIMENTS

Figure 1:
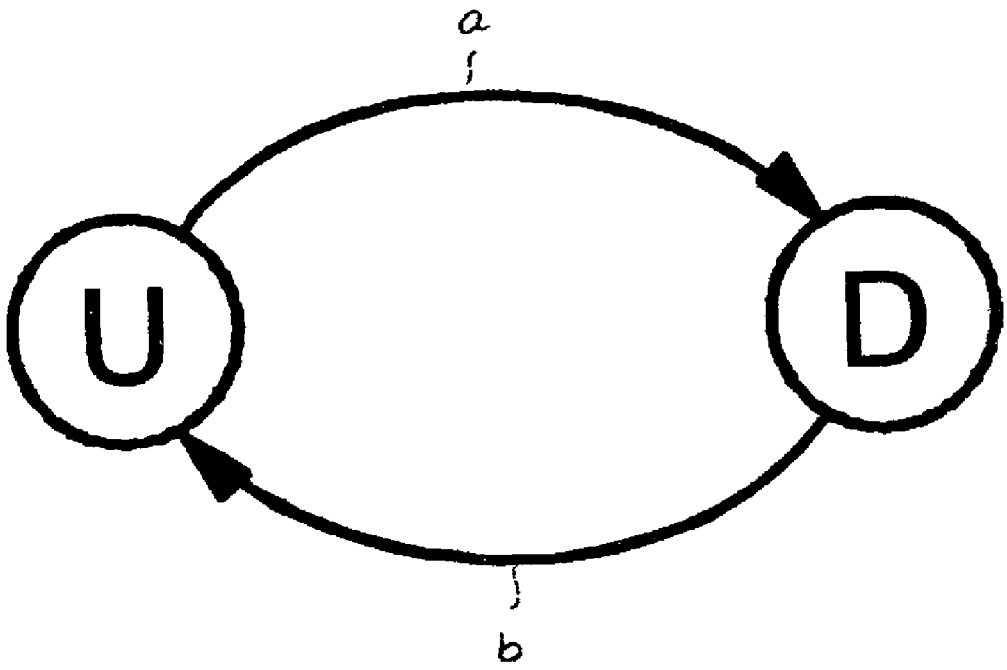
FIG. 1 is a simple model of a Markov chain to determine the characteristic value D.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and method, and such further applications of the principles of the invention as illustrated as would normally occur to one skilled in the art to which the invention relates are included.

According to the preferred embodiment, a characteristic value D is determined by use of which the status of the mixture made up of toner and carrier particles can be estimated. For this, a model calculation is used that in particular takes the LTO operation into account. The preferred embodiment proceeds from the consideration that the toner particles are subject to a constant wear in a running developer station, which wear damages the mixture (in particular negatively affects the triboelectric properties of the toner particles and their adhesion properties) in the course of the operation period. Given operation with average or high toner consumption, the running feed of fresh toner from the toner reservoir leads to a certain regeneration of the mixture. In contrast to this, barely any toner is consumed in printing in LTO operation, such that consequently only a little fresh toner is supplied to the developer station. As a result of the agitation of the mixture that is necessary for the mechanical properties of the toner mixture (in order to avoid a clump formation of toner particles, for example), the damage to the toner increases more and more. A significant influencing factor for the damage is thus the exchange rate with which fresh toner is supplied per time unit of the developer station. This exchange rate is accordingly taken into account in the model calculation given the determination of the characteristic value D for the status of the mixture. Furthermore, the operating aging rate, which refers to the actual time of the operation of the developer station in which the mixture is agitated, is taken into account in the determination of the characteristic value D. This operating aging rate refers to the proportion of old toner present in the developer station given operation of the developer station per time unit. Downtimes of the developer station are not taken into account.

In practice it has been shown that a characteristic value D that takes into account the cited variables of exchange rate and operating aging rate reflects the status of the mixture given changing operation with high, medium and low (LTO operation) toner consumption. The status of the mixture can be estimated and described well using such a characteristic value D, such that quality losses in printing can be avoided given a control or regulation of the developer process depending on this characteristic value D.

It is advantageous when the model calculation to determine the characteristic value D is based on a stochastic process in which the Markov chains (known from stochastics) are used. For this the possible states of individual toner particles are considered, wherein every toner particle should have only two states in a simple model. In a first state the toner particle in the developer station is undamaged; in a second state it is defective. The transitions from the first state to the second state occurs with established transition probabilities or transition rates. In an observation time period each toner particle which is agitated in the developer station in the operation of the developer station changes from the first state (undamaged) to the second state (defective) with a certain probability, namely the operating aging rate. This operating aging rate is the proportion of toner per time unit that is damaged by the agitation of the mixture in the developer station. In reverse, a defective toner particle is replaced by a new toner particle depending on the exchange rate with which toner is supplied to the running developer station, and therefore changes from the second state (defective) to the first state (undamaged). The operating aging rate is assumed to be constant given a running developer station and is thus a device constant. The exchange rate is dependent on toner throughput and is therefore a function of the toner consumption, which is in turn dependent on the areal coverage, the number of pixels per printed page, the degree of inking etc.

An occupation probability can be calculated for each state for the entire mixture, assuming that a sufficiently large number of toner particles is provided. The occupation probability has a value range from 0 to 1. For the case that no toner particles are damaged or defective, the occupation probability is 0. The sum of the occupation probabilities is equal to 1 in the Markov chain used here, since both states can only be assumed in alternating fashion and thus are complementary. This occupation probability is well suited as a characteristic state value for different operating states of the mixture. This occupation probability derived from stochastics is therefore used as a characteristic value D and is iteratively calculated in operation as follows:

$$P_i = a_i - (a_i + b_i) \cdot D_i$$

$$D_{i+1} = D_i + P_i \cdot \Delta T$$

wherein $D_i$ is the characteristic value D at the actual time increment i and $D_{i+1}$ is the characteristic value D at the next time increment i+1, i is a running variable for the time increments, $P_i$ is an auxiliary variable, a is the operating aging rate in 1/s, b is the exchange rate in 1/s and $\Delta T$ is the time increment size in s, wherein the value range of the characteristic value D is between 0 and 1.

The characteristic value $D_i$, $D_{i+1}$ indicates the occupation probability of the "defective" state at the time increment i (i.e. at the current time increment) or at the time increment i+1 (i.e. at the next time increment). The value $P_i$ is the change of the occupation probability at the time increment i and corresponds to the change of the value D per time unit. According to the second line of the equation system, the occupation probability $D_i$ is numerically integrated after every time increment. For this the current change $P_i$ is multiplied with the time increment size $\Delta T$ and is added to the value $D_i$. The value $D_i$ is periodically calculated in a time interval $\Delta T$ and is used as the cited characteristic value D. This characteristic value D describes the state of the entire mixture in the form of a single value at the time increment i and also comprises information about the prior history of this mixture. The value range of the characteristic value D is independent of additional influencing variables between 0 and 1. A high value of D indicates that the number of defective toner particles is large. A lower value indicates that the number of defective toner particles is low. The characteristic value D is therefore also descriptive in practical application, and its curve over the operating time of the developer station has a practical meaning.

According to an additional aspect of the preferred embodiment, a characteristic value E can be determined from a model calculation that well describes the state of the mixture even given changing operating phases, similar in manner to the characteristic value E. Here as well only the time in which the developer station is in operation (i.e. in which the mixture is agitated) is taken into account. Times in which the developer station is at rest are not considered, although the toner particles also age then. In this model calculation the change of the toner consumption rate is determined. Apart from the down time with which the supply of fresh toner occurs with a delay, this is proportional (or equal except for a scaling factor) to the exchange rate for fresh toner that was cited further above. A change of this toner consumption rate within a time interval ΔT is divided by a time constant T, and the result is taken into account in the formation of the characteristic value E. It has been shown that the characteristic value E over the operating time of the developer station also shows a similar behavior as the curve of the characteristic value D mentioned further above, even in different operating phases, in particular in LTO operation. This characteristic value E therefore likewise describes the current state of the mixture and takes its prior history into account.

It is advantageous when the characteristic value D and/or E is stored in a non-volatile memory and is associated with the associated developer station. As mentioned, the aging of the toner when the developer station is not in operation is not taken into account in the determination of both the characteristic value D and the characteristic value E. When the developer station is placed in operation again after an operating pause, the last value of the characteristic value D or R is retrieved from the memory and the further curve of the characteristic value D or R is determined starting from this value.

The characteristic values D or R are determined per developer station. Given multicolor printing with different toner colors, the characteristic values D and E are calculated for each mixture that contains the respective toner color.

The development process can be monitored on the basis of the determined characteristic values D and/or E. If D and/or E approaches a critical value, intervention in the development process can take place manually or automatically.

For a better understanding of the present preferred embodiment, reference is made in the following to the preferred exemplary embodiments presented in the drawings, which preferred exemplary embodiments are described using specific terminology. However, it is noted that the protective scope of the invention should not thereby be limited since such variations and further modifications to the shown devices and/or the methods, as well as such further applications of the invention as they are displayed therein, are viewed as typical present or future expert knowledge of a competent man skilled in the art.

As is mentioned further above, a stochastic process in which Markov chains are used is adopted to determine the characteristic value D in the model calculation for the behavior of the mixture. FIG. 1 shows the possible states of a single toner particle. In an undamaged state, the toner particle has the state U from which it can transition to a defective state D. The transitions from state U to state D occur according to an established transition probability, the operating aging rate a. Relative to all toner particles in the developer station, this operating aging rate a is the proportion of the toner per time unit that becomes damaged by the agitation and movement of the mixture in the developer station given operation of the developer station. In reverse, a defective toner particle with state D is replaced by a new toner particle depending on the exchange rate b with which fresh toner is supplied, and therefore the state D changes to the state U. The operating aging rate a is constant in a running developer station and can be empirically determined. Typical values lie in a range from 0.0001 1/s to 0.01 1/s, with a typical standard value of 0.0009 1/s.

The exchange rate b with which fresh toner is supplied from a reservoir to the mixture results from fresh toner in g/s relative to the toner contained in the agitated mixture (for example 50 to 250 g, depending on the structural size of the developer station) in g. It is a function of the toner consumption, which is in turn dependent on the areal coverage, the number of pixels per printed side, the degree of inking etc. The value range of b spans from 0 to 0.1 1/s and typically lies in a range from 0 to 0.0255 1/s.

The characteristic value D is iteratively calculated according to the following relationship:

$$P_i = a_i - (a_i + b_i) \cdot D_i$$

$$D_{i+1} = D_i + P_i \cdot \Delta T$$

wherein $D_i$ is the characteristic value D at the actual time increment i and $D_{i+1}$ is the characteristic value D at the next time increment i+1, i is a running variable for the time increments, $P_i$ is an auxiliary variable, a is the operating aging rate in 1/s, b is the exchange rate in 1/s and ΔT is the time increment size in s, wherein the value range of the characteristic value D is between 0 and 1.

Figure 2:
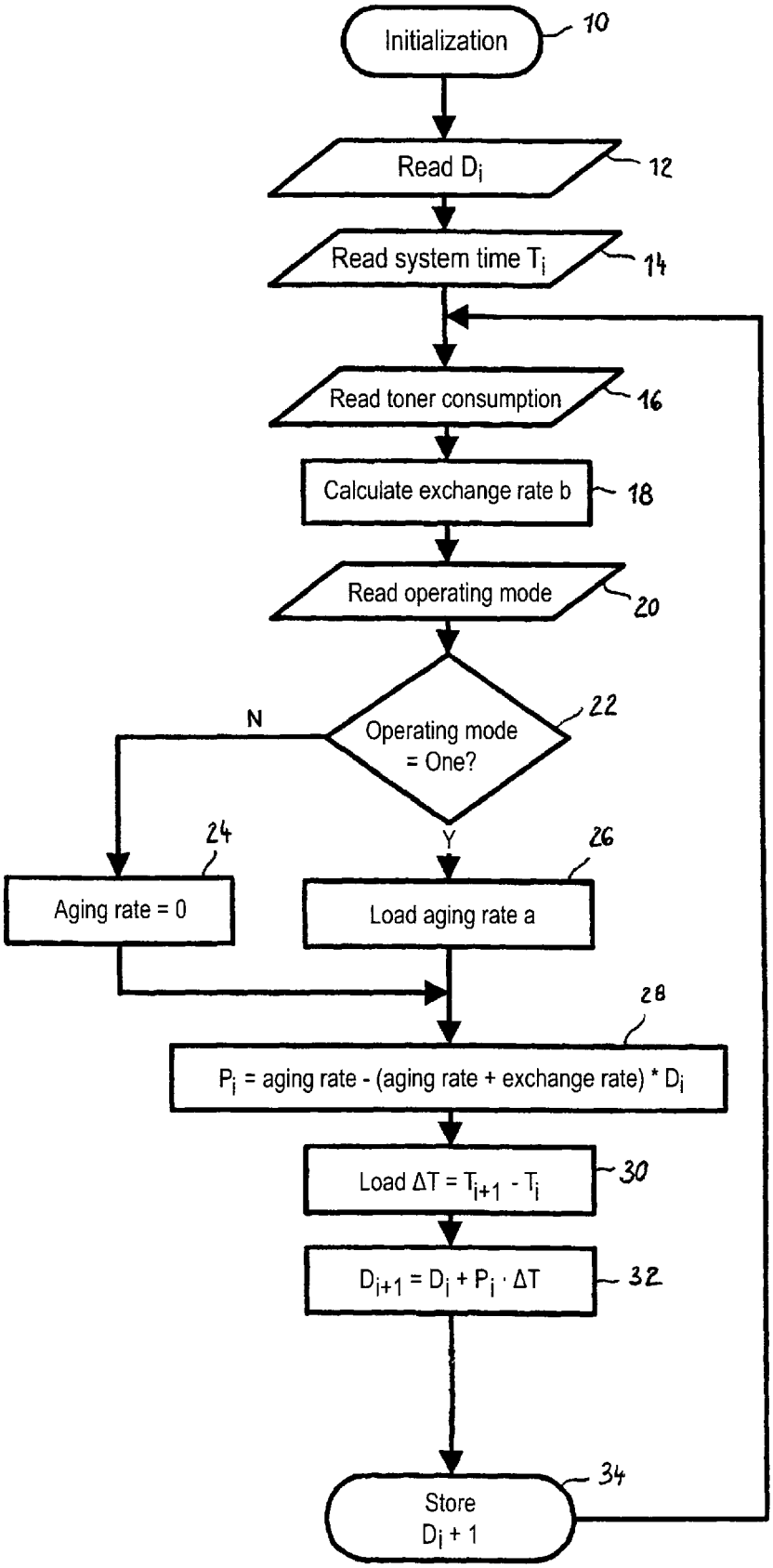
FIG. 2 shows a workflow diagram to determine the characteristic value D.

FIG. 2 shows a workflow diagram for iterative calculation of the characteristic value $D_i$. The workflow is realized by a computer software which is associated with the corresponding developer station. After the initialization in Step 10, the last stored characteristic value D is read from a memory (Step 12). Furthermore, the system time is read, meaning an absolute point in time or a relative point in time (derived from a system time counter, for example) in order to later be able to form the time difference ΔT from this.

In the next step, the current toner consumption is read (Step 16) and the current exchange rate is calculated from this (Step 18). The interrogation of the operating mode follows this (Step 20). In the event that the operating mode is not ONE (query block 22), the operating aging rate a is set to a value of 0 (Step 24). If the developer station is switched on and the mixture made up of toner particles and carrier particles is agitated, in Step 26 the operating aging rate a belonging to this developer station is loaded. This operating aging rate a is a device constant that is empirically determined.

In a next Step 28 the current value for the auxiliary variable $P_i$ is calculated according to the specified relation. In the following Step 30 the time difference ΔT that has passed since the last calculation is determined and the characteristic value D for the next time increment i+1 is determined from the sum of the previous value $D_i$ and the product of the auxiliary variable $P_i$ and ΔT. The determined value $D_{i+1}$ is subsequently stored and the method branches back to Step 16. Given a new pass of the loop, the previously calculated value $D_{i+1}$ is used as a value $D_i$.

The value range of the characteristic value $D_i$ is between 0 and 1 and has the practical meaning that it indicates the probability with which the toner is damaged in the developer station. The current value $D_i$ can be displayed in order to inform operators of the printer about the status of the mixture.

As was mentioned further above, a characteristic value R (which likewise informs about the status of the mixture) can be determined, wherein at least one time constant is taken into account in addition to a toner consumption rate that, apart from a down time and a scaling factor, approximately corresponds to the cited exchange rate b.

The characteristic value E is iteratively calculated according to the following relation:

$$d = m_i - V_i$$

$$Vi+1 = Vi + d^* \Delta T/\tau$$

$$E_{i+1} = 1 - V_{i+1}/V_{max}$$

wherein $E_i$ is the characteristic value E for the current time increment i and $E_{i+1}$ is the characteristic value for the next time increment i+1, i is a running variable for the time increments, $m_i$ is the current toner consumption in g/s, d is an auxiliary variable that indicates the change of the tone consumption per time segment, $V_i$, $V_{i+1}$ is an auxiliary variable that corresponds to a filtered consumption rate, $V_{max}$ is the maximum consumption rate in g/s for this developer station, τ is a time constant in s and ΔT is the time increment size in s, wherein the value range of the characteristic value $E_i$ is limited to the range between 0 and 1.

The characteristic value E or, respectively, $E_i$ is normalized, whereby its value range is limited. The normalization can also be foregone. V (or as a characteristic value $E_i=V_i$) or the difference from $V_{max}-V$ (or as a characteristic value $E_{i+1}=V_{max}-V_{i+1}$) can then be used as a characteristic value E.

Figure 3:
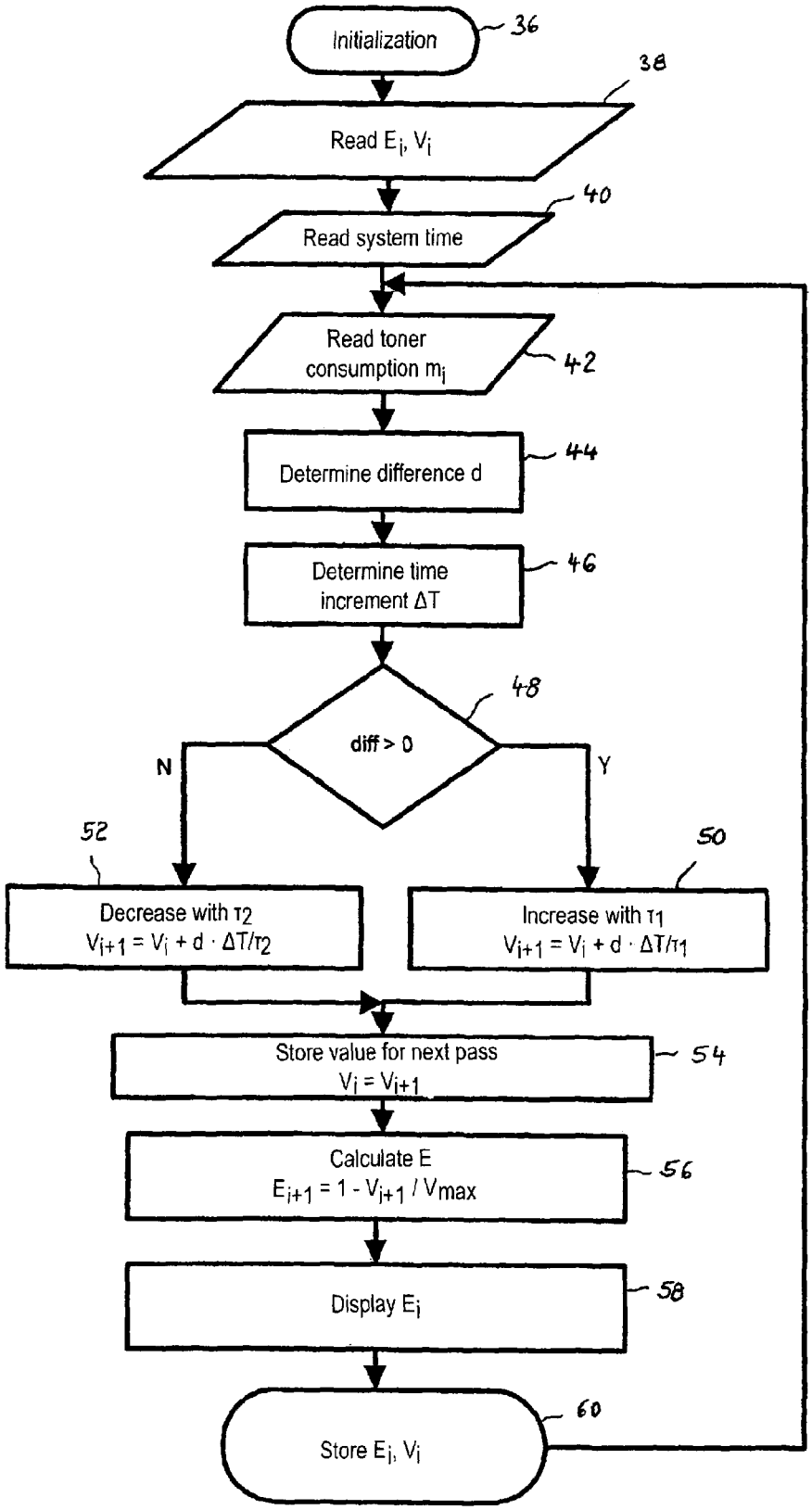
FIG. 3 illustrates a workflow diagram to determine the characteristic value E.

FIG. 3 shows an example of iterative determination of the characteristic value E using a computer program. After the initialization (Step 36), the last determined value of E and the auxiliary variable $V_i$ are read (Step 38). The current system time is read in the subsequent Step 40.

The current toner consumption rate $m_i$ is subsequently read in Step 42. The auxiliary variable difference d (Step 44) as well as the time increment size ΔT (Step 46) are subsequently determined.

Depending on whether the difference d has a positive or negative value, the method branches in Step 48. Given a positive difference (which means that the toner consumption increases and consequently an increased amount of fresh toner is also supplied), a first time constant τ1 is used in the model calculation in Step 50. If the difference is negative, meaning that the toner consumption decreases and the developer station approaches the LTO operation, a second time constant τ2 is used in the model calculation in Step 52. The difference d weighted with the quotients from t1 and ΔT or τ2 and ΔT are subsequently added (starting from the previous auxiliary variable $V_i$) and the auxiliary variable $V_{i+1}$ at the following time increment i+1 is determined (Steps 50, 52). The value of $V_{i+1}$ determined in Steps 50, 52 is subsequently stored in Step 54 as a value for $V_i$ for the next loop pass. The characteristic value E is calculated in the next Step 56, wherein the auxiliary variable V is normalized using the maximum occurring toner consumption rate $V_{max}$ in g/s in this developer station. In Step 58 the value E is displayed, by use of which an operator can estimate the current status of the mixture. The values $E_i$ and $V_i$ are subsequently stored in Step 60 and the method branches back to Step 42.

As mentioned, different time constants τ1 or τ2 are used in the formation of the characteristic value E depending on the algebraic sign of the difference f. Given a positive difference d (which means that the toner consumption increases and therefore an increased amount of fresh toner is supplied to the developer station), the time constant τ1 can be smaller and typically lies at a value of 120 s. A range from 50 to 150 s, in particular a range from 100 to 130 s, is preferred. Given a negative value of the difference d, the time constant τ2 is greater; and it is typically 600 s. The span from 300 to 1200 s, in particular 500 to 700 s, can be specified as a range of τ2. The different time constants are established in that the regeneration of the mixture is accelerated given an operating phase with increased infeed of fresh toner. In contrast to this, given a decreasing toner consumption, the toner particles remain in the developer station longer and thus are exposed to a longer damage duration, which is expressed by the longer time constant τ2. The use of different time constants increases the precision of the mapping of the real process in the characteristic value E.

Figure 4:
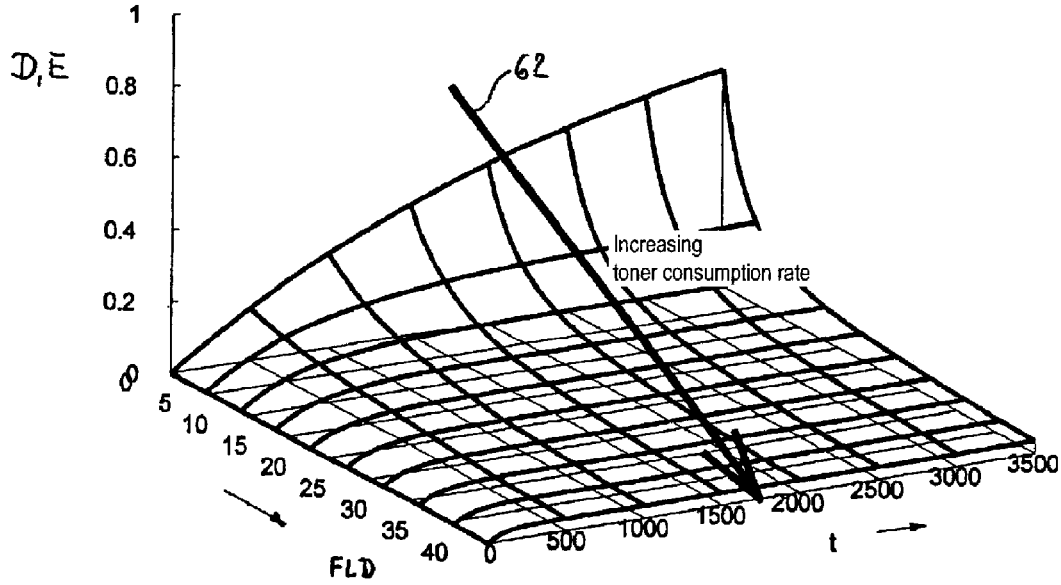
FIG. 4 shows a diagram which schematically reflects the correlation of areal coverage, time and characteristic value D or, respectively, E.

FIG. 4 shows characteristic lines of the characteristic value D or E in a value range from 0 to 1 over the time t in s with the parameter of areal coverage FLD in percent. The value FLD indicates how large the tonered surface of a recording media is in relation to the total printed surface. If is apparent that the characteristic value D or E is near 0 given a high FLD value. In relation to the characteristic value D this means that the probability of damaged toner particles is low. This is understandable because, given a high FLD value, a high toner consumption results, and therefore also a high infeed of fresh toner so that the residence duration of the toner within the developer station given operation of the same is low, and therefore the danger of the damage to toner particles is likewise reduced. The curve of the characteristic values D, E starts at the point in time t=0 given a value of 0 and ends at a different level depending on the areal coverage. If the areal coverage is low (for example 0%), the respective characteristic value D, E rises relatively significantly over time t. In relation to the characteristic value D this means that the probability of damaged toner particles rises since the toner exchange is reduced. Given an areal coverage smaller than 5%, the characteristic values D, E rise disproportionately as seen over time t. The arrow 62 indicates that the characteristic values D, E travel in the direction of 0 given increasing toner exchange rate and increasing areal coverage FLD.

Figure 5:
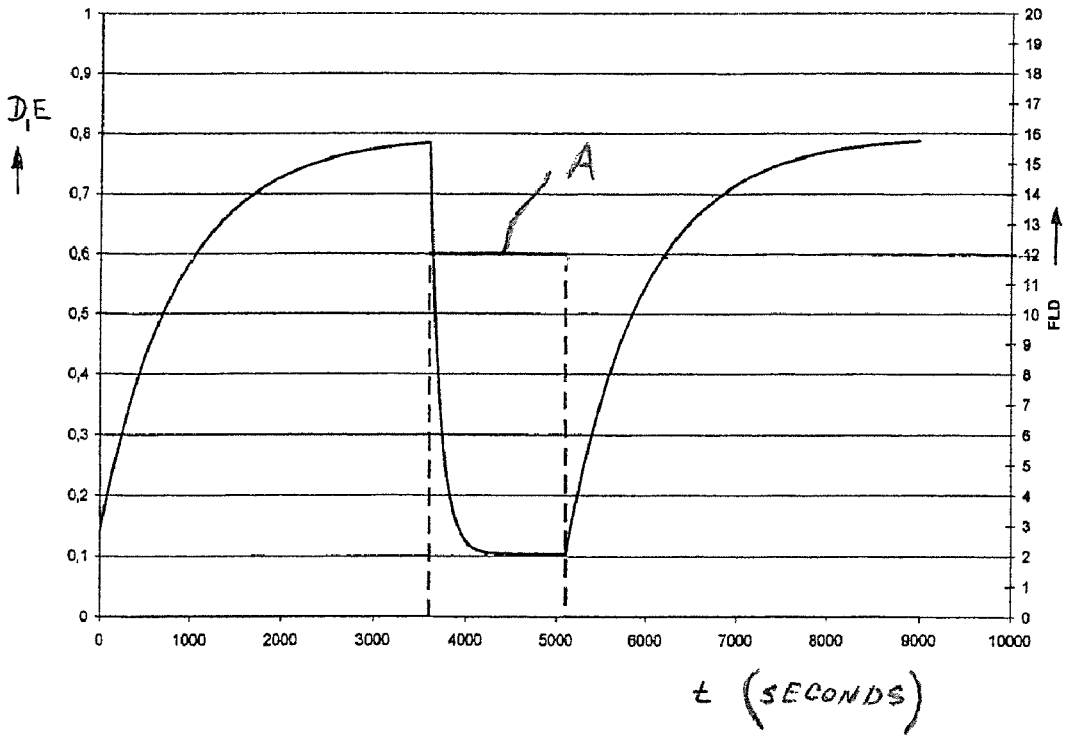
FIG. 5 is an example of the curve of the characteristic values D, E over the time given different operating phases.

FIG. 5 shows the curve of the characteristic values D, E over time t in s. The exchange rate b or the toner consumption rate m is proportional to the areal coverage FLD indicated in percent to the right in the diagram. Given an FLD value of 0, NTO operation (No Take-Out operation) is present. An LTO operation exists in a range up to approximately 4% FLD. It is initially assumed that an LTO operation with an FLD value smaller than 3% exists in a time range from 0 to 3500 s. It is apparent that the characteristic values D, E rise exponentially and reach a high value of nearly 0.8. In a time period A from 3500 s up to approximately 5200 s, a normal operation with an FLD value of 12% is present. Due to the now increased infeed of fresh toner, the mixture regenerates and the characteristic values D, E drop exponentially to a value of approximately 0.1. If an LTO operation or an NTO operation thereupon occurs again as of the point in time 5200 s, the characteristic values D, E exponentially increase again. This behavior, which was determined with the aid of the model computer in FIG. 5, is also to be ascertained in reality. The characteristic line thus reflects the actual behavior of the mixture in good approximation to reality.

The iteratively calculated values D and E alone can already be used to reflect and to monitor the status of the mixture made up of toner particles and carrier particles. It is then advantageous to display the current value of D and E as a quality parameter for operators of the printer. If the value of D and E increases starting from a low value in the direction of the maximum value 1, this means that LTO operation is present and a critical state for the developer station can be reached. If the characteristic value D, E exceeds a fixed threshold, regeneration techniques for the mixture can be introduced. For example, additional toner surfaces to increase the toner consumption can be printed in normal printing operation, for example as this is described in the documents U.S. Pat. Nos. 7,079,794 and 7,085,506 cited further above. Another possibility is to interrupt the normal printing operation and to replace or feed in a certain quantity of toner by developing and cleaning the toner on the intermediate carrier.

An additional possibility is the implementation of a mixture exchange upon exceeding a threshold.

In practice it has been shown that, in LTO operation, the toner concentration TC measured by a toner concentration sensor in the developer station no longer exactly applies due to the damage to the toner particles. In a regulatory loop to regulate the toner concentration (the toner concentration TC results from the ratio of toner in g to mass g of the entire mixture) this error has the effect that the toner concentration TC drops so that a too-low toner inking occurs on the intermediate carrier. The characteristic values D and E can be used to compensate the TC value in LTO operation.

Figure 6:
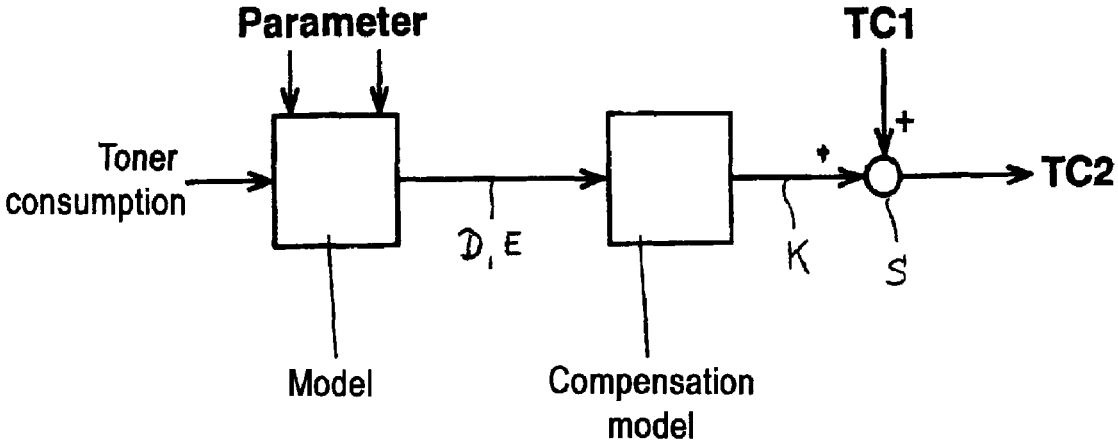
FIG. 6 shows the compensation of the desired value for a toner concentration regulation.

In this regard, FIG. 6 shows an example of a compensation chain in which a real value of a toner concentration TC1 is corrected to a real value TC2. Depending on the toner consumption, the characteristic value D or E is determined in a model calculation with incorporation of characteristic device parameters (which are designated as parameters in FIG. 6). Compensation values K are calculated with the aid of a computational compensation model (for example a characteristic line equation with incorporation of additional device parameters), which compensation values K are subtracted from a real value of the measured toner concentration value TC1 at a summation term S so that the toner compensation value TC2 that represents an input variable for the toner concentration regulation in the developer station is generated as a real value. The drop of the toner concentration can be counteracted in this way for various operating phases (in particular an LTO operating phase).

In the simplest case, the compensation value K is calculated via multiplication of the characteristic value D with an empirical constant factor k1 to be determined:

$$K=k1\cdot D$$

$$TC2=TC1+K$$

Reasonable values for k1 lie in the range from 0 to 1.5 (typically at +0.65) relative to the TC1.

The characteristic value E can likewise be used for compensation. Further correction terms can additionally be included in the compensation model, for example using a parameterizable polynomial which describes a specific characteristic line. The compensation model could also contain separate input value ranges that respectively calculate a different part of a characteristic output line. For this, for example, it is possible to take into account a correction only as of a threshold of the characteristic values D, E.

The toner consumption can be estimated by counting the pixels to be printed. For example, a pixel counter counts the pixels of the pixels generated by a character generator. The toner consumption per time unit can be determined using known parameters such as page length of the page to be printed, print speed and ink level. The determination of the toner consumption using a pixel counter is described in the aforementioned document WO 2004/012015 A1.

An inking regulation is subsequently described as an additional example of the application of the characteristic values D and E. It has been shown that the inking on the recording media is reduced given a change from normal operation to an LTO operation. This variation can be reproduced with the aid of a model calculation with incorporation of the characteristic values D, E. In relation to the characteristic value E it is advantageous to differentiate between a rising and a falling print utilization and to use different time constants for this in the determination of this characteristic value E. The time constants τ1 and τ2 (see the workflow diagram according to FIG. 3 for this) hereby increase the precision of the model simulation.

Figure 7:
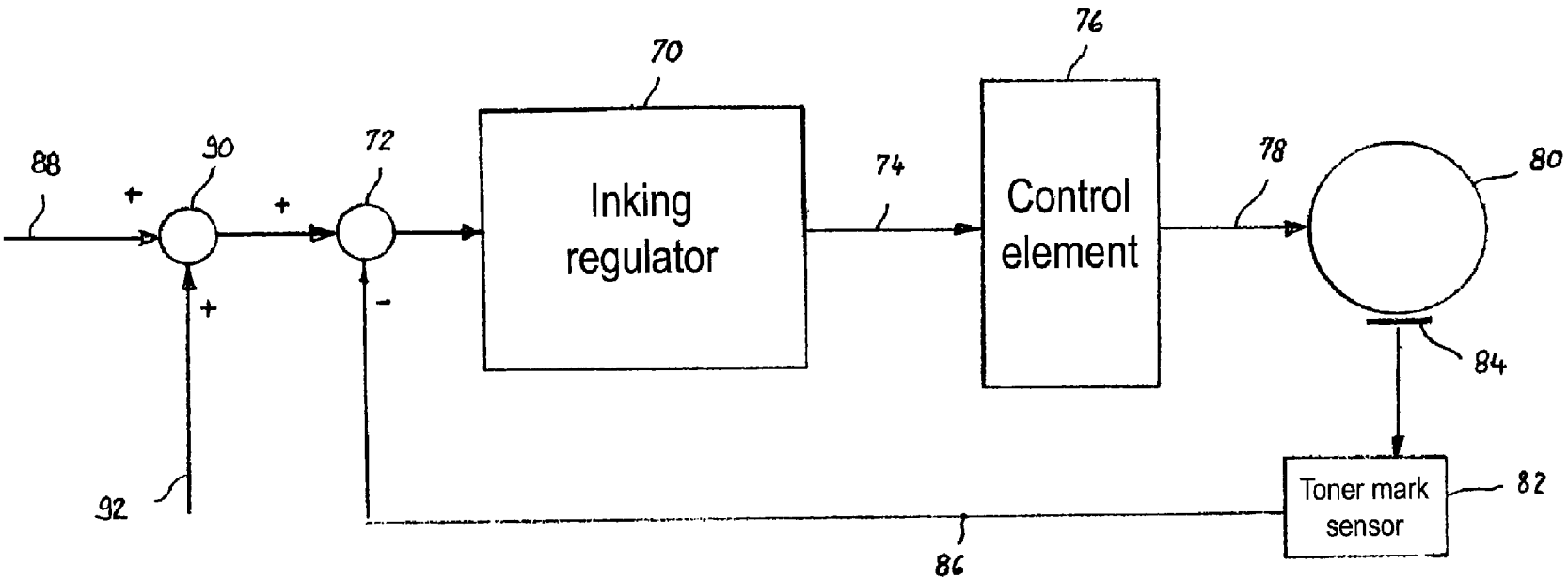
FIG. 7 illustrates a regulatory loop for inking regulation with a correction of the desired value for the inking regulator.

FIG. 7 shows the basic principle of an inking regulation with a correction in an LTO operation. An inking regulator 70 determines a regulator signal 74 from a desired-real value comparison at the summation point 72, which regulator signal 74 activates a control element 76 of the developer station. For example, this control element outputs a voltage 78 as an output value, the value of which voltage 78 determines the layer thickness of the toner on an intermediate carrier 80 (for example a photoconductor drum or a photoconductor belt). A toner mark sensor 82 measures the layer thickness of a toner mark 84, and therefore the degree of thinking. The real value 86 of the toner mark sensor 82 is supplied to the summation term 72 to form the desired-real value deviation. A desired value 88 (which can be varied in stages in order to adjust the desired greyscale value, for example) is supplied to the inking regulation loop to adjust the inking. In order to compensate the fluctuations of the inking depending on the operation of the developer station (in particular in an LTO operation), an additional summation element 90 is interposed and this is charged with a correction signal 92.

Figure 8:
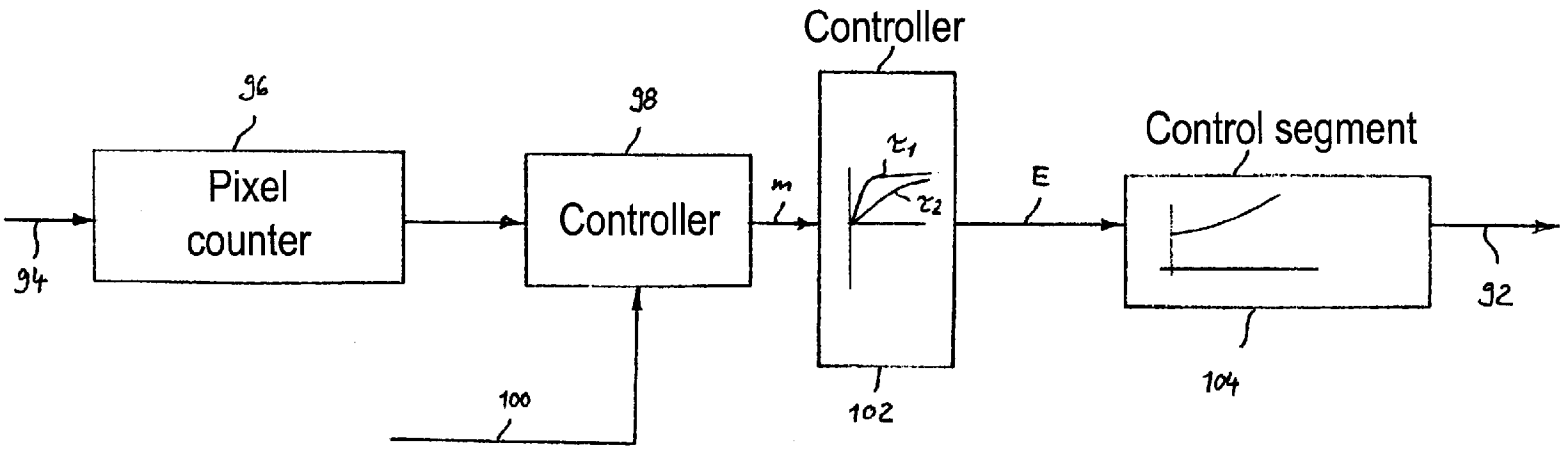
FIG. 8 shows a block diagram for the determination of the correction value.

FIG. 8 shows the generation of this correction signal 92 using the characteristic value E as it is determined according to the workflow diagram according to FIG. 3. A degree of areal coverage is determined from the signals 94 of a character generator with the aid of a pixel counter 96. A controller 98 determines the toner consumption rate m from a signal 100 for the set inking level under consideration of additional device parameters. With the aid of a computer program, a controller 102 calculates the characteristic value E with incorporation of the time constants τ1 and τ2. The correlation between the characteristic value E and the correction value 92 is non-linear. Given a normal operation, the correction value 92 should have the value 0 so that the desired value 88 is supplied to the summation element 72 without alteration. Given an LTO operation, the correction value 92 should rise in order to generate a higher desired value for the inking regulation which compensates for the inking degradation in the LTO operation. In a control segment 104, the correction value 92 from the characteristic value E is determined with the aid of a characteristic line that represents a second-order polynomial. The coefficients for this polynomial are empirically determined.

Alternatively, the characteristic value D can also be used instead of the characteristic value E in the example of the inking regulation according to FIGS. 7 and 8, for which the characteristic line is to be adapted to this characteristic value D in the control segment 104.

According to the preferred embodiment, characteristic values D and E are provided that well describe the real status of the mixture made up of toner and carrier particles as state parameters.

Because an LTO operation cannot be directly determined by a sensor, this operating state can be indirectly detected from observation of the continually determined characteristic values D and E. The model calculation for the characteristic values D and E require only a few constants to be determined empirically. The time response of the occurring technical effects is well reflected by the characteristic values D, E in different operating states. Given use in a toner concentration regulation, the too-low toner concentration value occurring in the LTO operation can be raised and therefore adjusted.

Measures for regeneration of the toner mixture with high precision can be implemented using the characteristic values D and E. Unnecessary regeneration cycles, and therefore an unnecessarily high toner consumption, are avoided due to the simulation of the mixture state in the characteristic values D and E. The otherwise typical regeneration cycles for the mixture are accordingly conducted neither too early (which would lead to an increased toner consumption) nor too late (which would reduce the print quality).

Although preferred exemplary embodiments have been shown and described in detail in the drawings and in the preceding specification, these should be viewed as purely exemplary and not as limiting the invention. It is noted that only the preferred exemplary embodiments are shown and described, and all variations and modifications that presently and in the future lie within the protective scope of the invention should be protected.

We claim as our invention:

1. A method to control a development process in an electrographic process and electrographic printer or copier, comprising the steps of:

with at least one developer station inking a latent image on an intermediate carrier with toner of a predetermined color, the toner being extracted from a mixture made up of toner and carrier particles, and wherein fresh toner is supplied to the mixture;

determining a characteristic value D for a status of the mixture from a model calculation in which a toner exchange rate b with which fresh toner is supplied to the mixture per time increment, and an operating aging rate a which indicates a proportion of toner that remains in the developer station and is thereby damaged by re-use per time increment of operation of the developer station, are linked;

at least one of monitoring, controlling, or regulating the development process, dependent on the characteristic value D; and in which the characteristic value D is calculated iteratively according to a relationship $$P_i=a_i-(a_i+b_i)\cdot D_i$$

$$D_{i+1}=D_i+P_i\cdot\Delta T$$

wherein $D_i$ is the characteristic value D at an actual time increment i and $D_{i+1}$ is the characteristic value D at a next time increment i +1, i is a running variable for the time increments, $P_i$ is an auxiliary variable, $a_i$ is the operating aging rate in 1/s, $b_i$ is the exchange rate in 1/s and ΔT is the time increment size in s.

2. A method according to claim 1 wherein the exchange rate $b_i$ is determined by counting pixels to be printed.

3. A method according to claim 1 wherein, when the characteristic value D exceeds an established threshold, a toner consumption is increased as a regeneration technique for the mixture wherein additional toner surfaces are printed or a predetermined amount of toner is extracted from the mixture and fresh toner is supplied so that the consumed toner is replaced by said fresh toner and said toner concentration in said mixture remains substantially unchanged.

4. A method according to claim 1 wherein said toner concentration in the mixture is set dependent on the calculated characteristic value D.

5. A method according to claim 1 wherein the characteristic value D is displayed as a characteristic quality value for the mixture made up of the toner particles and the carrier particles.

6. A method according to claim 1 wherein the characteristic value D is stored in a non-volatile memory and is associated with an associated developer station.

7. A method according to claim 1 wherein a regulation of the inking of the latent image by the toner occurs depending on the calculated characteristic value D.

8. A method according to claim 1 wherein the characteristic value D is determined per mixture for a multicolor printing with multiple color toner mixtures.

9. A method for controlling a development process in an electrographic printer or copier, comprising the steps of:

with at least one developer station inking a latent image on an intermediate carrier with toner of a predetermined color, the toner being extracted from a mixture made up of toner and carrier particles, and fresh toner being supplied to the mixture;

determining a characteristic value E for a status of the mixture from a model calculation in which a change of a toner consumption rate for the toner within a time increment ΔT during operation of the developer station and a time constant τ are taken into account;

at least one of monitoring, controlling, or regulating the development process depending on the characteristic value E; and the characteristic value E is iteratively calculated according to a relationship $$d=m_i-V_i$$

$$V_{i+1}=V_i+d*\Delta T/\tau$$

$$E_{i+1}=1-V_{i+1}/V_{max}$$

wherein $E_i$ is the characteristic value E for a current time increment i and $E_{i+1}$ is the characteristic value for a next time increment i +1, i is a running variable for the time increments, $m_i$ is a current toner consumption rate in g/s, d is a variable indicating change of toner consumption per time increment, $V_i$, $V_{i+1}$ is a variable corresponding to a filtered consumption rate, $V_{max}$ is a maximum consumption rate in g/s, τ is a time constant in s, and ΔT is a time increment size in s, wherein a value range of the characteristic value $E_i$ is limited to the range between 0 and 1.

10. A method according to claim 9 in which a value of the time constant τ is dependent on an algebraic sign of variable d.

11. A method according to claim 10 in which a first time constant τ is in a range from 50 to 150 s is used given a positive value of the variable d.

12. A method according to claim 10 in which a second value $\tau_2$ for the time constant τ is used given a negative value of the variable d.

13. A method according to claim 9 in which the toner consumption rate $m_i$ is determined by counting pixels to be printed.

14. A method according to claim 9 in which, when the characteristic value E exceeds an established threshold, the toner consumption is increased as a regeneration technique for the mixture, wherein additional toner surfaces are printed or a predetermined amount of the toner is extracted from the mixture and fresh toner is supplied.

15. A method according to claim 9 in which said toner concentration TC in the mixture is set dependent on the calculated characteristic value E.

16. A method according to claim 9 in which the characteristic value E is displayed as a characteristic quality value for the mixture made up of the toner p articles and the carrier particles.

17. A method according to claim 9 in which the characteristic value is stored in a non-volatile memory and is associated with an associated developer station.

18. A method according to claim 9 in which said regulating of the inking of the latent image by the toner occurs depending on the calculated characteristic value E.

19. A method according to claim 9 in which the characteristic value E is determined per mixture for a multicolor printing with multiple color toner mixtures.

* * * * *